United States Patent [19]

Elsmore et al.

[11] Patent Number: 4,683,469

[45] Date of Patent: Jul. 28, 1987

[54] DISPLAY TERMINAL HAVING MULTIPLE CHARACTER DISPLAY FORMATS

[75] Inventors: Jeff Elsmore, Tempe; Kenneth W. Stoorza; Timothy A. Walker, both of Phoenix, all of Ariz.

[73] Assignee: ITT Corporation, New York, N.Y.

[21] Appl. No.: 711,912

[22] Filed: Mar. 14, 1985

[51] Int. Cl.[4] ..... G09G 1/06

[52] U.S. Cl. ..... 340/723; 340/748

[58] Field of Search ..... 340/723, 731, 735, 736, 340/744, 745, 748, 750

[56] References Cited

U.S. PATENT DOCUMENTS

| | | | |
|---|---|---|---|
| 4,193,071 | 3/1980 | Hasegawa et al. | 340/723 |
| 4,283,724 | 8/1981 | Edwards | 340/731 |
| 4,435,703 | 3/1984 | Hunt et al. | 340/723 |
| 4,495,594 | 1/1985 | Eggebrecht et al. | 340/723 X |
| 4,574,279 | 3/1986 | Roberts | 340/745 x |
| 4,575,717 | 3/1986 | Fedele | 340/723 X |

*Primary Examiner*—Gerald L. Brigance
*Assistant Examiner*—Vincent Kovalick
*Attorney, Agent, or Firm*—T. L. Peterson; J. M. May

[57] ABSTRACT

A display terminal adapted to present character information, in any one of a plurality of different display formats, within a display frame having approximately constant dimensions. The terminal preferably includes a programmable CRT controller, first and second character memories, horizontal and vertical deflection circuits for selectably generating output signals having first or second periods, a central processor and circuitry for generating constant frequency dot clock and character clock signals. In establishing each display format, the central processor programs the CRT controller with the display parameters that are appropriate for that format and generates a plurality of display format control signals for controlling the selection of a character memory and the periods of the output signals of the horizontal and vertical deflection circuits. Together, these parameters and format control signals assure that the desired character information is presented within a display frame having the desired dimensions and that the aspect ratios of the characters are maintained within acceptable limits.

35 Claims, 8 Drawing Figures

FIG. 2

DISPLAY PARAMETERS

| | DISPLAY FORMAT (SCREEN SIZE) | | | | |
|---|---|---|---|---|---|
| | 1920 | 2560 | 3440 | 3564 | UNITS |
| 1. DISPLAYED CHAR./ROW | 80 | 80 | 80 | 132 | CHAR. |
| 2. DISPLAYED CHAR. ROWS | 24 | 32 | 43 | 27 | ROWS |
| 3. DOT CLOCK PERIOD | 44.44 | 44.44 | 44.44 | 44.44 | N SEC |
| 4. CHAR. CLOCK PERIOD | 400 | 400 | 400 | 400 | N SEC |
| 5. DOT TIMES/CHAR. CELL | 9 | 9 | 9 | 9 | DOT TIMES |
| 6. RASTER LINES/CHAR. CELL | 16 | 12 | 10 | 10 | LINES |
| 7. DOTS/CHAR. | 7 | 7 | 6(OR 7) | 6(OR 7) | DOT |
| 8. RASTER LINES/CHAR. | 8 | 8 | 7 | 7 | LINES |
| 9. DOTS/FRAME DISP. | 720 | 720 | 720 | 1188 | DOTS |
| 10. DOTS/FRAME TOTAL | 900 | 900 | 900 | 1368 | DOTS |
| 11. LINES/FRAME DISP. | 400 | 396 | 440 | 280 | LINES |
| 12. LINES/FRAME TOTAL | 417 | 417 | 457 | 292 | LINES |
| 13. STEP SCAN USED | NO | NO | NO | YES | — |
| 14. HORIZ. LINE RATE | 25 | 25 | 25 | 16.4 | KHZ |
| 15. HORIZ. LINE PERIOD | 40 | 40 | 40 | 60.8 | $\mu$SEC |
| 16. VERT. REFRESH RATE | 59.95 | 59.95 | 54.4 | 56.3 | HZ |
| 17. VERT. FRAME PERIOD | 16.68 | 16.68 | 18.29 | 17.75 | M SEC |

HORIZ. DEFL. YOKE
BAKER CLAMP
CURRENT AMP
555 TIMER
TH
D/S
OUT
TRIG
CV
R
FILTER
POWER SWITCHES
SYNC
NE5560
DCA MOD
R-OSC
C-OSC
+46/73
+46/+73
COL. SELECT
HS
+5V
+15
+95

DISPLAY TERMINAL HAVING MULTIPLE CHARACTER DISPLAY FORMATS

BACKGROUND OF THE INVENTION

The present invention relates to cathode-ray tube display terminals and is directed more particularly to a display terminal which is adapted to present character information, in any one of a plurality of different formats, within a display frame having approximately constant dimensions.

In systems in which a host computer operates in conjunction with a plurality of display terminals, with or without an intermediate controller, it is common for the host computer to run application programs that instruct each terminal to display character information in a particular logical screen size or display format. The host computer may, for example, request the terminal to present character information in a 1920 screen size which includes 24 character rows of 80 characters each plus one 80 character status row, or in a 2560 screen size which includes 32 character rows of 80 characters each plus one 80 character status row, etc. Prior to the present invention, terminals were designed to present character information in only one format, which format might or might not match that requested by the host computer.

In the event that a terminal of the above-mentioned type is requested to use a logical screen size other than the one for which it was designed, one of two results will occur. Firstly, if the logical screen size is smaller than the physical screen size, characters will be displayed within a display frame which includes an unsightly blank area having a size which is proportional to the difference between the physical and logical screen sizes. Secondly, if the logical screen size is larger than the physical screen size, the display will be forced to reject the host computer's request to use that logical screen size. In order to avoid these results, it has been necessary for an operator to move to or connect up a terminal which was designed to use the desired screen size.

Prior to the present invention, there were a number of reasons why terminals were designed to use only a single display format. One reason is that changes in the number of character rows within a display frame require changes in the number of horizontal scan lines that must be presented during the vertical period of the display. In addition, changes in the number of character columns within a display frame require changes in the number of horizontal dots or pixels that must be presented during the horizontal period of the display. The problem of dealing with these different numbers of lines and pixels is compounded by the fact that both of these variables impact the refresh rate of the display, which must be maintained at a high enough rate to prevent the display from producing a perceptible flicker. This problem is further compounded by the fact that changes from one display format to another can cause the aspect ratios of the characters, i.e., the ratios of the widths to the heights of the characters, to vary outside of acceptable limits.

In order to solve the above-described problems, it had appeared, prior to the present invention, that the ability of a single terminal to accommodate a plurality of different display formats required the provision of a plurality of different selectable horizontal and vertical deflection circuits, a plurality of different character clock and dot clock signal generators, a plurality of different selectable character memories, and circuitry for controlling the selection thereof. Because the use of this approach requires the duplication of a substantial portion of the terminal circuitry, the cost of its adoption has been prohibitive.

SUMMARY OF THE INVENTION

In accordance with the present invention there is provided a display terminal which is adapted to present character information in any one of a plurality of different display formats, within a display frame having approximately constant dimensions, but which does not require the use of duplicate sets of terminal circuitry.

Generally speaking, the terminal of the present invention includes circuitry for generating constant frequency dot clock and character clock signals, together with control circuitry which controls various parameters of the display, such as the spacing between character rows and the heights of the characters, as necessary to maintain the displayed character information within a display frame having approximately constant dimensions.

In the preferred embodiment, the terminal of the invention includes a CRT controller which is adapted to control the timing of the display in accordance with a programmed set of display parameters, together with horizontal and vertical deflection circuits which are adapted to generate horizontal and vertical deflection signals having selectable one of two different periods, and a character memory which is adapted to provide character data in a selectable one of two different fonts. In addition, the terminal of the invention includes a terminal central processor which serves to program the CRT controller with a set of display parameters which is compatible with the desired display format, and to apply to the horizontal and vertical deflection circuits and the character memories a corresponding set of display format control signals. Together these display parameters and format control signals cause the terminal to present the desired characters in the desired display format. Thus, by controllably reprogramming itself, the terminal of the invention allows character information to be represented in any of a plurality of different display formats, within a display frame having approximately constant dimensions, without using duplicate sets of terminal circuitry.

In the preferred embodiment, the terminal of the invention reprograms itself during the vertical retrace time of the display, thereby preventing changes in display format from causing the presentation of garbled information. Such changes in display format are preferably made by the terminal central processor on the basis of actual and desired format signals which are stored in predetermined locations in the main terminal memory. This allows the host computer or its associated controller to write a request for a new display format into the terminal memory while the terminal processor is displaying characters in another format. During the vertical retrace of the display, the processor compares the actual and desired display formats and, if necessary, reprograms the terminal to make any necessary changes in format before the presentation of the next display frame.

If the terminal operates as a part of a system which uses the Systems Network Architecture (SNA) protocol, changes in display format can be made only by the host computer. If the system uses a non-SNA protocol, however, the terminal may be programmed to change display formats at the request of the operator. The terminal may, for example, be programmed to respond to the pressing of a set-up key by presenting a panel which requests the operator to select the desired display format. Thus, the display terminal of the present invention may be used without regard to the type of protocol which is used for communication between the host computer and the terminal.

DESCRIPTION OF THE DRAWINGS

Other objects and advantages of the present invention will be apparent from the following description and drawings in which:

FIG. 2 is a table that lists selected ones of the display parameters which are associated with the display formats shown in FIG. 1;

DESCRIPTION OF THE PREFERRED EMBODIMENTS

Figure 1:
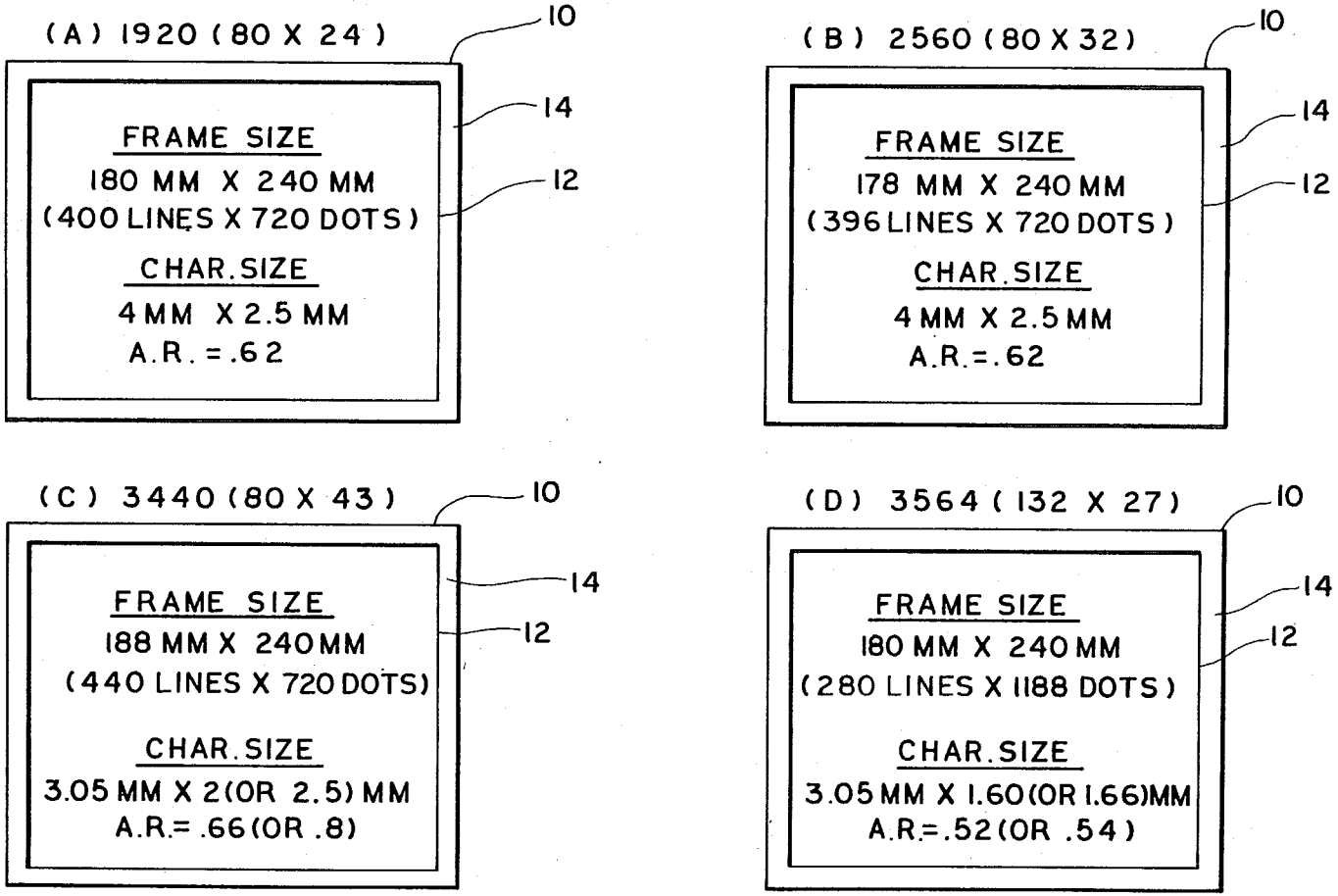
FIGS. 1A–1D are simplified front views of display screens which show the relationship between logical screen size and physical screen size for four different display formats.

Referring to FIGS. 1A–1D, there are shown the outlines of four display screens, together with the outlines of the display frames which are associated with the four different display formats that can be displayed thereon. FIG. 1A, for example, shows the outline of a display screen 10 together with the outline of a display frame 12 which contains the character information associated with the so-called 1920 display format. As indicated by the parenthetical numbers 80×24, this display format includes 1920 characters which are arranged in 24 character rows of 80 characters each. (Also included within display frame 12 is a status row including an additional 80 characters.) As indicated by the numbers shown under the heading Frame Size, display frame 12 has dimensions of approximately 180 mm by 240 mm and includes up to 400 horizontal scan lines each of which, in turn, includes up to 720 dots or pixels. Display frame 12 is surrounded by blank margins such as 14 which are defined by the difference between the physical size of the display frame and the physical size of the display screen. The distribution of characters between the lines and dots of display frame 12 will be described later in connection with FIG. 2.

FIG. 1B shows the outline of a display screen 10 together with the outline of a display frame 12 which contains the character information associated with the 2560 display format. As shown by the parenthetical numbers 80×32, this display format includes 32 columns of 80 characters each (plus a status row including an additional 80 characters). As indicated by the numbers shown under the heading Frame Size, this display frame has approximately the same physical dimensions as display frame 12 of FIG. 1A and includes approximately the same number of horizontal scan lines and the same number of dots. Thus, in spite of its greater number of rows and characters, the 2560 display format occupies a display frame which has approximately the same dimensions as that of the 1920 display format and fills approximately the same amount of space on display screen 10.

FIG. 1C shows the outline of a display screen 10 together with the outline of a display frame 12 which contains the character information associated with the 3440 display format. As shown by the parenthetical numbers 80×43, this display format includes 43 columns of 80 characters each (plus a status row including an additional 80 characters). As indicated by the numbers shown under the heading Frame Size, this display frame has dimensions of approximately 188×240 mm and includes up to 440 horizontal scan lines each including up to 720 dots. Thus, in spite of its greater number of rows and characters, the 3440 display format occupies a display frame which has approximately the same dimensions as those of the 1920 and 2560 display formats and fills approximately the same amount of space on display screen 10. Finally, FIG. 1D shows the outline of a display screen 10 together with the outline of a display frame 12 which contains the character information associated with the 3564 display format. As indicated by the parenthetical numbers 132×27, this display format includes 27 rows of 132 characters each (plus a status row including an additional 132 characters). As indicated by the numbers shown under the heading Frame Size, this display frame has dimensions of 180×240 mm and includes up to 280 displayed horizontal scan lines each including up to 1,188 dots. Thus, in spite of its different number of rows and characters, the 3564 display format occupies a display frame which has approximately the same dimensions as those of the 1920, 2560 and 3440 display formats and fills approximately the same amount of space on display screen 10.

As indicated by the numbers shown under the headings Character Size, the display frames of FIGS. 1A–1D not only have approximately the same size, but also include characters which have aspect ratios (A. R.) greater than 0.5. This means that the ratio of the width of each character to the height thereof is greater than 0.5 in spite of changes in display format. In addition, all four display formats have characters with widths that are equal to or greater than 1.6 mm. The aesthetic significance of these aspect ratios and widths is reflected by the fact that government promulgated standards recommend that characters have aspect ratios greater than 0.5 and widths of at least 1.6 mm. It will therefore be seen that the display frame size constancy afforded by the present invention is not achieved by producing characters which have aspect ratios or character widths which are outside of acceptable limits.

Figure 3:
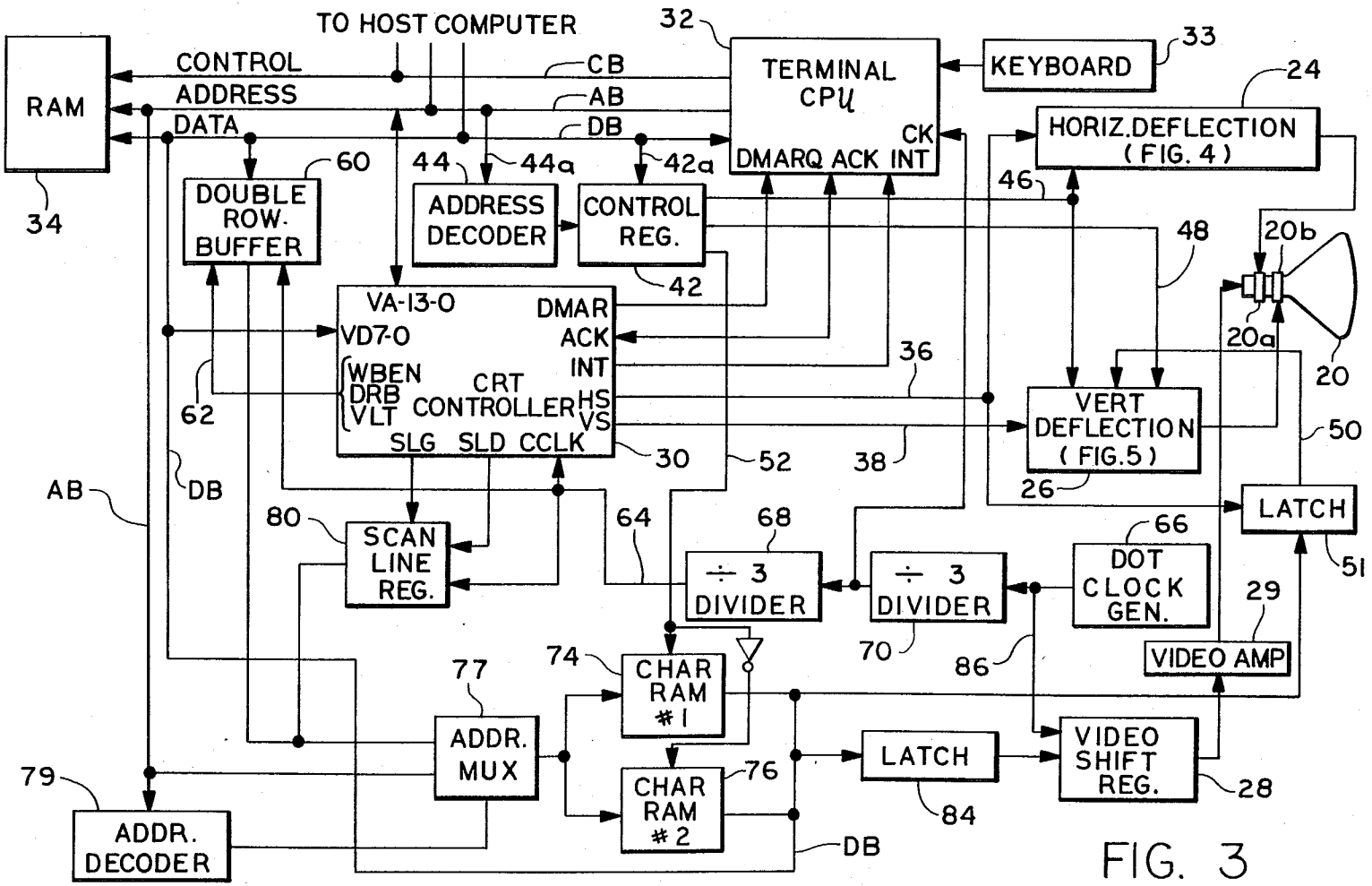
FIG. 3 is a block diagram of the preferred embodiment of the display terminal of the invention.
Figure 4:
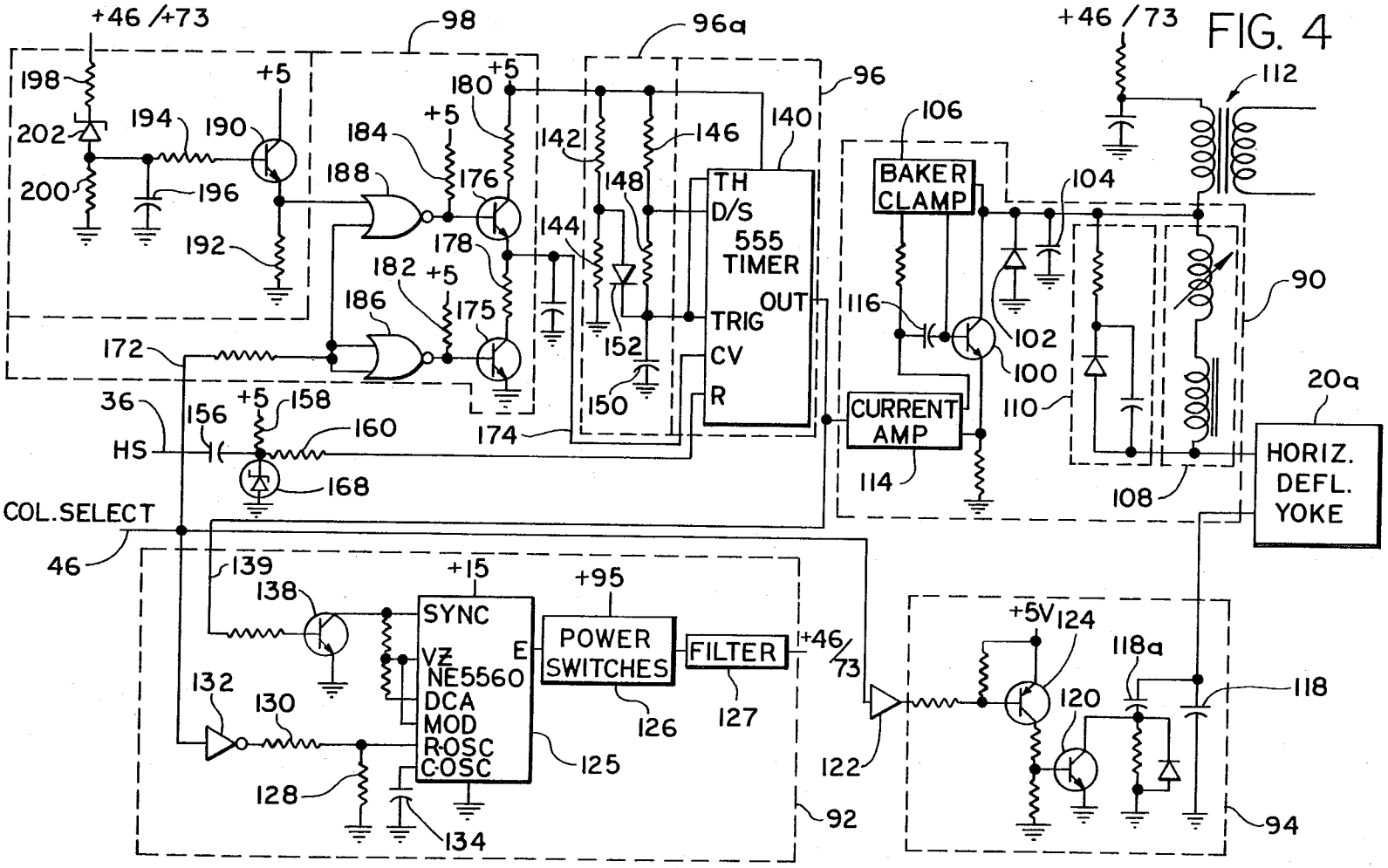
FIG. 4 is a schematic-block diagram of the horizontal deflection circuitry shown in block form in FIG. 3.
Figure 5:
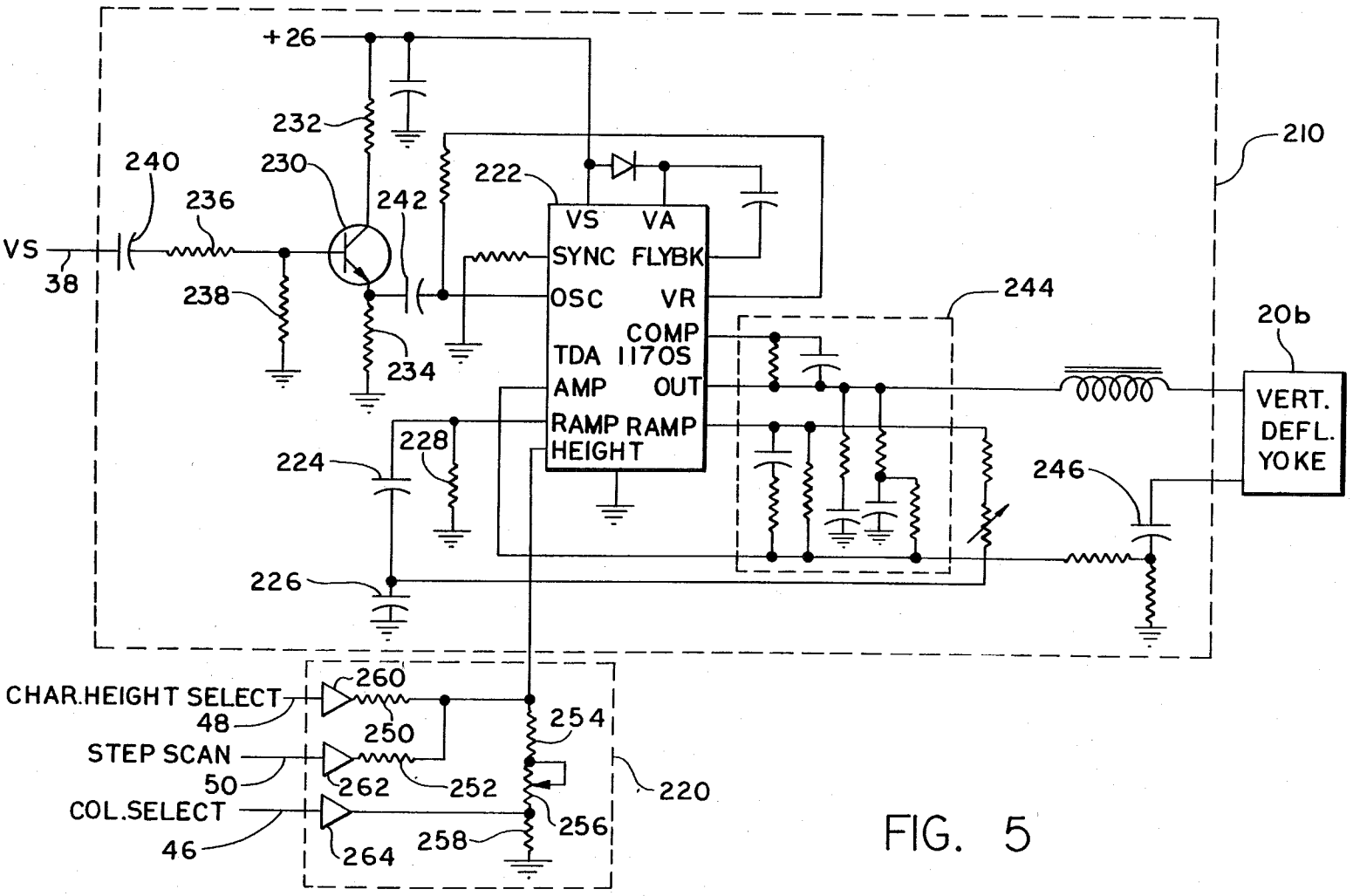
FIG. 5 is a schematic-block diagram of the vertical deflection circuitry shown in block form in FIG. 3.

Before describing how the circuits of FIGS. 3, 4 and 5 produce the results shown in FIGS. 1A–1D, it is helpful to first understand how characters are distributed within the display frames in each of the different display formats. Accordingly, these character distributions will now be described with reference to the table of FIG. 2.

Referring to FIG. 2, there are listed the principal parameters or variables which are associated with the presentation of characters in each of the four above-mentioned display formats. The first two of these parameters, the number of displayed characters per row and the number of displayed character rows (not including status rows), are the same as those mentioned earlier in connection with FIGS. 1A–1D. The third of these parameters, the dot clock period or minimum time between horizontally adjacent dots is 44.44 ns and is the same for all display formats. The fourth of these parameters, the character clock period or maximum time necessary to display a complete horizontal slice of a character, is equal to 400 ns and is also the same for all display formats. This sameness of dot clock and character clock periods is highly desirable because it allows the terminal to generate the dot clock signal with only a single oscillator which operates at 22.5 mHz, and allows the character clock signal to be derived from the dot clock signal by a divide-by-nine frequency divider. Thus, the terminal of the invention uses only a single, constant frequency oscillator to control the presentation of character information in all four different display formats.

In order for the desired numbers of characters per row and character rows to be generated using constant frequency dot clock and character clock signals, the remaining display parameters of the four display formats preferably take on the differing values shown in the remainder of FIG. 2. Entries 5–8 of FIG. 2, for example, indicate that the 1920 and 2560 display formats both use characters having dimensions of 7 dots by 8 lines, but that these characters are presented within character cells (i.e., characters together with their associated inter-character and inter-line spaces) having dimensions of 9 dots by 16 lines and 9 dots by 12 lines, respectively. Stated differently, while the characters presented in the 1920 and 2560 display formats are the same size, these characters are presented within character cells which have different vertical sizes. Because of the lesser height of the 2560 format character cell, the spacing between character rows is less in that format. This, in turn, allows more character rows to be presented in a display frame which has approximately the same vertical dimension as that of the 1920 display format.

Similarly, entries 5–8 of FIG. 2 indicate that both the 3440 and 3564 formats use characters having dimensions of 6 or 7* dots by 7 lines, and are presented within character cells having dimensions of 9 dots by 10 lines. Because the 3440 and 3564 display formats both use characters and character cells which are made up of the same numbers of dot and lines, the differences in character density that are necessary to display the characters of these formats within display frames having sizes similar to those of the 1920 and 2560 display formats are produced by using different numbers of displayed lines per frame and different horizontal line rates. In the case of the 3440 display format, for example, the increased vertical character density necessary to display 43 character rows within a frame having a height which is approximately the same as that of the 1920 and 2560 formats is produced in part by decreasing the number of lines per character from 8 to 7 and in part by increasing the number of lines per frame from 400 to 440. Because the circuit of the invention is designed to use at most two different horizontal line rates, this increased number of lines per frame increases the vertical period of the display from 16.68 ms to 18.29 ms and, correspondingly, reduces the vertical refresh rate of the display from 59.95 Hz (frames per second) to 54.4 Hz.

* In the preferred embodiment, some characters (such as H) are 6 dots wide, while others (such as M) are 7 dots wide. This variation in width assures desirable shapes for all characters in the character set.

Because of the higher horizontal and lower vertical character density which characterizes the 3564 display format, it is not produced in the manner just described in connection with the 3440 display format. Instead, the 3564 display format is produced in part by decreasing the horizontal line rate or, equivalently, increasing the horizontal period. This, in turn, decreases the horizontal dot spacing and packs a greater total number of dots in each horizontal line. More particularly, as indicated by entry 14 of table 2, the number of horizontal dots per row is increased from 720 to 1188 by decreasing the horizontal line rate from 25 kHz (a 40 microsecond period) to 16.4 kHz (a 60.8 microsecond period). The 3564 display format is also produced in part by decreasing the total number of displayed lines per frame from 440 to 280 and by dividing these lines among 28 relatively widely spaced character rows. In the preferred embodiment, the spacing of the rows is increased without appreciably increasing the vertical period of the display by utilizing a feature known as stepscan. This feature, which will be described in greater detail later, allows the electron beam to be vertically stepped through the spaces between the character rows without spending the time necessary to sweep through the lines that would normally occupy those spaces. As a result, although the 3564 display format requires the electron beam to spend more time to paint each horizontal line and row of the display, the reduced number of lines per frame together with the use of stepscan between rows allows the vertical refresh rate of the 3564 display format (56.3 Hz) to be approximately equal to that of the other display formats and thereby prevent any perceptible flicker.

In view of the foregoing, it will be seen that the circuitry of the invention is able to present character information in any one of four different display formats, within a display frame having approximately constant dimensions, without perceptible flicker, even though it uses (i) constant frequency dot clock and character clock signals, (ii) only two different character fonts, (iii) only two different horizontal line rates, and (iv) a variable number of displayed lines per frame together with stepscan. This circuitry will now be described with reference to the block diagram of FIG. 3 and the schematic diagrams of FIGS. 4 and 5.

Referring to FIG. 3, there is shown in simplified form a cathode-ray tube display or CRT 20 having a horizontal deflection yoke 20*a* and a vertical deflection yoke 20*b*, all of which may be of types well-known to those skilled in the art. Horizontal deflection yoke 20*a* is driven by a horizontal deflection circuit 24 which will be described more fully later in connection with FIG. 4. Similarly, vertical deflection yoke 20*b* is driven by a vertical deflection circuit 26 which will be described more fully later in connection with FIG. 5. Also shown in FIG. 3 is a video shift register 28 which, via a video amplifier 29, modulates the intensity of the electron beam driven by deflection circuits 24 and 26 as necessary to cause character information to be presented at the desired points on the face of CRT 20.

In order to cause horizontal and vertical deflection circuits 24 and 26 and video shift register 28 to present character information in a selectable one of the display formats discussed in connection with FIGS. 1 and 2, the circuit of FIG. 3 includes a first programmable control means 30, which preferably takes the form of a CRT controller integrated circuit such as that sold by Standard Microsystems Corporation under the model designation CRT 9007, a second programmable control means 32, which preferably takes the form of an integrated circuit central processor or microprocessor such as that sold by Motorola, Inc. under the model designation 68000, together with their associated circuits, interconnecting lines and buses.

As will be explained more fully presently, processor 32 is programmed to refer to data stored in predetermined locations in the terminal's main random access memory or RAM 34 and to determine therefrom the display format with which character information is to be presented on display 20. Based on this desired format data, processor 32 programs controller 30 with the display parameters that are associated with that format. Controller 30, in turn, uses these display parameters to generate a horizontal sync (HS) signal for application to horizontal deflection circuit 24 via line 36, a vertical sync (VS) signal for application to vertical deflection circuit 26 via line 38, as well as certain other signals to be discussed later.

At the same time, processor 32 generates or controls the generation of a plurality of display format control signals which, together with the signals produced by controller 30, cause character information to be presented in the desired format on display 20. Included among these display format control signals are a column or horizontal rate select signal which is applied to horizontal and vertical deflection circuits 24 and 26 via a line 46, a character height or vertical rate select signal which is applied to vertical deflection circuit 26 via line 48, a character memory select signal which is applied to character memories 74 and 76 via a line 52, and a step-scan select signal which is applied to vertical deflection circuit 26 via a latch 51 and a line 50. In the preferred embodiment, all but one of these display format control signals are generated by means of a control register 42 having inputs 42*a* connected to terminal data bus DB in conjunction with an address decoder 44 having inputs 44*a* connected to terminal address bus AB.

The manner in which CRT controller 30 and processor 32 cooperate to present character information in any of the formats shown in FIG. 2 will now be described. In order for characters to be displayed on CRT 20, character codes which correspond to the characters to be displayed at respective character positions of the display must first be loaded into terminal RAM 34. These character codes may be loaded into memory 34 either as a result of the depression of character keys on a keyboard 33, or as a result of downloading from the host computer and any associated controller (not shown) via terminal data and address buses DB and AB. As these character codes are loaded, they are preferably stored in row-table format. This means that the character codes for the characters on each line of the display are stored in a block of adjacent memory locations in RAM 34, and that the beginning address for each such block is stored in a table in RAM 34. As a result, when the processor is ready to present a row of characters, it need only refer to the row-table to determine the starting address of the associated block of memory and then successively read the character codes stored therein.

Depending on the display format in which the characters are to be displayed, the section of main memory 34 which contains the character information for each complete frame of the display will be one of 24, 32, 43 or 27 blocks long, each block including either 80 or 132 character codes. As a result, as the display terminal switches from one display format to another, it rewrites the codes for the characters to be displayed in the new format in a form which has the number and length of blocks that are associated with that new format and then rewrites the row-table. Because programs that are able to accomplish this rewriting will be apparent to those skilled in the art, they will not be described in detail herein.

In order to present a row of characters on CRT 20, the character codes for the entire row are preferably first loaded into a double row buffer 60, which is preferably of the type sold by Standard Microsystems Corp. under the model designation CRT 9212. This double row buffer, which is specially designed for operation with a model CRT 9007 controller, includes two character buffers each of which has sufficient storage capacity to store the character codes for a complete row of the display. One of these buffers, known as the "read" buffer, is read during the presentation of the current row of the display in order to provide the necessary character data to video shift register 28. At the same time, the other buffer, known as the "write" buffer, is loaded with the character codes for the next row of the display. As the presentation of a row is completed, the double row buffer is toggled to reverse the roles of the buffers and thereby cause them to present of the next row of the display while loading data for the following row. In order to prevent memory access conflicts, controller 30 is adapted to steal cycles from processor 32 in order to directly transfer blocks of character codes from memory 34 to double row buffer 60. These transfers occur as controller 32 exchanges control signals with processor 32 via its outputs labeled DMAR (Direct Memory Access Request), ACK (Acknowledge) and INT (Interrupt). When memory access is granted, controller 30 addresses memory 34 via outputs VA 13-0 thereof, causing character codes to be loaded into double row buffer 60 via data bus DB. This loading is controlled by a set of control signals which are applied via a set of control lines 62 and by the character clock signal which is applied to controller 30 and to double row buffer 60 via line 64. The latter signal is preferably produced by dividing the frequency of the dot clock signal generated by a dot clock signal generator 66 by 9 via two divide-by-3 divider circuits 68 and 70. Because the operation of double row buffer 60 is known to those skilled in the art, it will not be further described herein.

Because the characters whose codes are stored in double row buffer 60 must be presented on a plurality of different horizontal scan lines, it is necessary to convert the character codes stored in the read buffer thereof into concatenated strings of character slices, each of which includes the pattern of dots necessary to display one line of the associated character. The dot patterns corresponding to each horizontal slice of each displayable character are stored in a character memory which preferably takes the form of a read/write random access memory or RAM. Because, as explained in connection with FIG. 2, each character must be capable of presentation in two different sizes, ($7\times8$ or $6\times7$), the circuit of FIG. 3 includes two such character RAM's 74 and 76. In the preferred embodiment character memories 74 and 76 are loaded with the dot patterns or fonts for each character to be displayed thereby during the start-up of the terminal. This loading of character fonts is desirable because it allows the terminal to display a variety of different fonts, such as those associated with non-English languages. In FIG. 3 this loading is accomplished by processor 32 via terminal address bus AB and terminal data bus DB, based on data received from the host computer or controller. In preparing for this loading, processor 32 selects or enables the memory to be loaded by establishing the proper state of the memory select signal on line 52, via control register 42. It then connects terminal address bus AB to the address inputs of the selected memory by establishing the proper state of an address multiplexer 77, via an address decoder 79.

While implementing character memories 74 and 76 in RAM is desirable because it allows different character fonts to be loaded into the terminal, the provision of changeable character fonts is not an essential feature of the present invention. It will therefore be understood that character memories 74 and 76 may comprise read only memories or ROM's and that address multiplexer 77 and address decoder 79 may be eliminated.

In order to display the pattern of dots which are to occupy each character position of each horizontal line of the display, in the desired display format, the terminal of the invention must address the character memory having the font that is associated with that display format at the address that corresponds to the proper horizontal slice of the character which is associated with that character position. In accordance with the present invention, the character memory having the correct character font is selected by processor 32. This selection is accomplished by causing control register 42 to selectably enable the desired character memory 74 or 76, via line 52, and by connecting the address inputs of the selected memory to double row buffer 60 and to a scan line register 80 via address multiplexer 77. Once the proper character memory has been enabled and connected in this manner, the character slice which is to be displayed in each character position is determined, in part, by the character code stored in double row buffer 60 for that character position and, in part, by controller 30 via scan line register 80. More particularly, the 8 bit character code for the character which is to appear in the current character position is used as the 8 most significant bits of the address of that character in the selected character memory, while the contents of scan line register 80 are used as the four least significant bits of the address of that character. Scan line register 80 is loaded with the current scan line count for the current character row, by controller 30 via the SLD (Scan Line Data) output thereof. This loading is accomplished by shifting the current scan line count into register 80 with the character clock signal under the control of the gate signal appearing at the SLG (Scan Line Gate) output of controller 30.

Because the number of scan lines per character cell varies from one display format to another, the number of different numerical values which must be produced by register 80 during the presentation of each character row will also vary from one display format to another. The 1920 display format, for example, requires register 80 to output 16 different numerical values for each row while the 2560 display format requires it to output 12 different numerical values for each row. Similarly, the 3440 and 3564 display formats require register 80 to output 10 different numerical values for each row. The number of scan lines that are used is controlled by processor 32, which communicates this number to controller 30 as a part of the process of loading or programming the same with the parameters which are associated with each display format.

As the character slices addressed by double row buffer 6O and scan line register 80 are successively output from the character memory selected by processor 32, they are latched into a latch 84 which supplies them to video shift register 28. These character slices are shifted through video shift register 28 by the dot clock signal which is supplied thereto by dot clock signal generator 66 via line 86. As this occurs, the data contained in the character slices is presented as character information along the current line of the current row of the display. Because the operation of video shift registers with character memories is known to those skilled in the art, it will not be further described herein. The manner in which horizontal deflection circuit 24 causes the output of video shift register 28 to be presented on CRT 20 in a form that is compatible with the selected display format will now be described with reference to FIG. 4. In FIG. 4 the horizontal deflection yoke **20*a* is shown in block form on the right, and the control lines 36 and 46 which supply the circuitry with the previously mentioned horizontal sync (HS) and column select signals are shown at the left. In the preferred embodiment, the circuit of FIG. 4 includes a horizontal drive network 90 which generates an output signal suitable for driving deflection yoke 20*a*, a switching type power supply 92 which produces a selectable one of two different regulated dc output voltages, an S-shaping network 94 which provides a selectable one of two different values of S-shaping for the drive current through yoke 20*a*, a timing network 96 and a duty cycle control network 98**.

The operation of circuit of FIG. 4 is controlled in part by the column select signal which processor 32 applies thereto via control register 42 and line 46. This signal determines which of the two horizontal line rates shown in FIG. 2 will be used in driving yoke **20*a*. The operation of the circuit of FIG. 4 is also controlled in part by horizontal sync signal HS which controller 32 applies thereto via line 36. This signal determines the beginning and ending times of each horizontal line of the display in accordance with the horizontal timing parameters that are loaded therein by processor 32 in the course of establishing the desired display format. Thus, as was the case with the character generating circuitry of FIG. 3, the circuitry of FIG. 4 is in part controlled by signals generated by processor 32 and in part controlled by signals generated by controller 30**.

To the end that horizontal drive network 90 may drive yoke **20*a* with a generally sawtooth shaped signal which causes the electron beam to move horizontally across CRT 20, network 90 includes a switching transistor 100, a damping diode 102, a capacitor 104, a baker clamp network 106 and width adjusting and linearizing networks 108 and 110, all of which are connected to a source of dc drive voltage. The latter voltage, which is produced by switching power supply 92, has one of two values, depending upon the state of the column select signal on line 46. This dc voltage is applied to drive network 90 through a conventional fly-back transformer 112 which serves to supply the operating voltage of the second anode of CRT 20** (not shown) in a known manner.

When power supply 92 applies the higher of its two output voltages (+73 volts) to drive network 90, the latter network supplies a relatively steeply sloped sawtooth signal to yoke **20*a*, causing the electron beam to sweep across CRT 20 at a relatively rapid rate, such as that associated with the 1920, 2560 and 3440 display formats. When power supply 92 applies the lower of its two output voltages (+46 volts) to drive network 90, however, the latter supplies a less steeply sloped sawtooth signal to yoke 20*a*, causing the electron beam to sweep across CRT 20 at a relatively slow rate, such as that associated with the 3564 display format. In both cases, however, the sawtooth signal has substantially the same peak to peak amplitude, thereby assuring that the width of the display frame remains substantially the same for all display formats. Thus, the different horizontal line rates produced by the circuit of FIG. 4 are produced by changing the dc voltage which is applied to drive network 90**.

During operation, the on-off switching of transistor 100 is controlled by horizontal sync signal HS which is applied thereto through timing network 96, a current amplifier network 114 and a speed-up capacitor 116. Of these, timing network 96 is for all practical purposes transparent to the HS signal when the latter is present, and current amplifier 114 serves merely to increase the magnitude of the drive current for transistor 100. In addition, Baker clamp network 106 serves in a well-known manner prevent transistor 100 from being driven far into saturation during its on state and thereby improves the switching speed thereof.

The operation of drive network 90 may be summarized as follows. At the beginning of the horizontal sweep, transistor 100 is in its off state. Under this condition the current through yoke 20*a* is at a maximum and decreases approximately linearly to drive the beam horizontally across CRT 20. Just before the beam reaches the middle of the screen, the horizontal sync signal causes transistor 100 to turn on, thereby effectively grounding the upper end of the yoke. Under this condition the yoke current is at a minimum and begins to increase approximately linearly to drive the beam beyond the middle of the screen. As the beam reaches the opposite side of the screen, transistor 100 is once again turned off. Under this condition the yoke current is shifted to capacitor 104 to initiate a resonant discharge which results in a reversal in the direction of current flow in the yoke and in the horizontal retrace of the electron beam. During this retrace, the beam is returned to its original position and the drive cycle is repeated. Because this operation is well understood by those skilled in the art, it will not be further described herein.

In accordance with one feature of the present invention, the above described operation of drive network 90 is caused to proceed at either of two different rates, depending on the state of the column select signal on line 46. As stated earlier these rates are selected by applying dc operating voltages of either +73 volts or +46 volts to network 90, these voltages having been found to produce the desired horizontal line rates while maintaining a display frame width which does not change as a result of changes in display format. In the preferred embodiment this is accomplished by using a power supply 92 which is adapted to selectably produce either of these voltages and by using the state of the column select signal to control the selection of these voltages. The manner in which this control is exerted will be described later in connection with the description of power supply 92.

During the time that drive network 90 is supplied with the higher of the two available dc voltages, capacitor 118 of S-shaping network 94 introduces a slight S-shaped curvature into the waveform of the sawtooth signal. As is well-known to those skilled in the art, this S-shaping improves the ability of the beam to maintain equal horizontal distances between displayed dots that are separated by equal times. Unfortunately, the degree of S-shaping which is necessary for the 25 khz horizontal line rate is not the same as that which is necessary for the 16.4 khz horizontal line rate. As a result, when the dc voltage applied to network 90 is switched from the high voltage value associated with the first three display formats to the lower voltage value associated with the 3564 display format, a horizontal distortion will appear on display 20 unless the capacitance which S-shaping network 94 presents to yoke 20*a* is increased. In accordance with one feature of the present invention, the desired additional degree of S-shaping is provided by connecting an additional capacitor 118*a* in parallel with S-shaping capacitor 118, during those times when the 3564 display format is being used. This connection is accomplished by a switching transistor 120 which is turned on by the column select signal on line 46 when the state of the latter indicates the selection of the 3564 display format. More particularly, as the column select signal assumes its 132 column state, it drives the output of amplifier 122 to near ground potential, thereby turning on a pnp transistor 124 which, in turn, turns on npn transistor 120 to connect capacitor 118*a* in parallel with capacitor 118. It will therefore be seen that the column select signal not only causes the use of the proper horizontal line rate, but also causes the use of the degree of S-shaping that is correct for that line rate, thereby maintaining the proper horizontal relationships between the horizontal dots in spite of changes in display format.

In the embodiment of FIG. 4, power supply 92 comprises a "buck converter" which includes a switching mode power supply control chip 125 that may be of the type manufactured by Signetics Corporation under the model designation NE5560. As is known to those skilled in the art, this control chip produces at output E thereof a square wave voltage the free-running frequency of which is a function of the resistance and capacitance values connected to the R-OSC and C-OSC inputs thereof. When the column select signal indicates that operation in one of the first three display formats is desired, resistors 128 and 130 are effectively connected in parallel by an inverter 132. This, in turn, allows the switching of chip 125 to be synchronized by the relatively high frequency horizontal sync signal applied thereto via line 139. Under this condition control chip 125 applies a relatively long duty-cycle voltage to power switches 126 and thereby causes the latter and its associated low pass filter 127 to establish a relatively high dc voltage at the output of network 92. When, on the other hand, the column select signal indicates that operation in the 3564 display format is desired, resistor 130 is effectively removed from across resistor 130 by inverter 132. This, in turn, allows the switching of chip 125 to be synchronized by the relatively low frequency horizontal sync signal applied thereto. Under this condition, control chip 125 applies a relatively short duty cycle voltage to power switches 126 and thereby causes the latter and its associated low pass filter 127 to establish a relatively low dc voltage at the output of network 92. Thus, power supply network 92 will provide the dc operating voltages necessary to drive yoke 20*a* at either of the two desired rates, depending on the state of the column select signal on line 46.

In order to eliminate asynchronous interference, it is desirable for the switching transitions of control chip 125 to occur at the same time as the transitions of the horizontal sync signal. In order to assure that this occurs in spite of those changes in the horizontal sync signal frequency that are associated with changes in display format, the SYNC input of control chip 125 is driven by the same horizontal sync signal which is applied to drive network 90. In the circuit of FIG. 4 this is accomplished by connecting a transistor 138 to the SYNC input of chip 125 and by applying the input signal of drive network 90 to the base of that transistor via conductor 139. It will therefore be seen that the display terminal of the invention remains free of asynchronous interference in spite of changes in display format.

In order to assure that the CRT 20 may be operated in a free-running mode, i.e., in the absence of a horizontal sync signal, drive network 90 is driven by the horizontal sync signal through a timing network 96 which is capable of free-running operation. This ability to operate in a free-running mode is desirable because it facilitates the repair of the terminal by helping to isolate faults. To the end that this may be accomplished, timing network 96 includes a 555-type timer 140 which is adapted to apply to drive network 90 an output signal having a waveform that is similar to that of the horizontal sync signal. The frequency and duty cycle of this voltage is fixed by an RC network 96A which includes timing resistors 146 and 148 and a timing capacitor 150 which are connected in a conventional manner to the inputs of timer 140. RC network 96A preferably also includes resistors 142 and 144 and a diode 152 which, by maintaining a predetermined minimum voltage across capacitor 150, prevent timing network 96 from applying an excessively long output pulse to drive network 90 when it is switched from its free-running mode to its synchronized mode.

In order to assure that the output of timing network 96 can be synchronized with the horizontal sync signal during normal operation, RC network 96A is arranged to cause timer 140 to exhibit a free-running period which is slightly longer than that of the horizontal sync signal. This longer period allows the output of timer 140 to be directly controlled by (i.e., to follow) the horizontal sync signal which is applied to reset input R of timer 140 via line 36, a capacitor 156, resistors 158 and 160 and a zener diode 168. (The latter elements comprise an ac coupling network which allows the horizontal sync signal to pass without substantial change, but which prevents a potentially troublesome dc connection from being established.) When the terminal of the invention is producing one of the first three display formats, the horizontal sync signal will cause timer 140 to produce an output voltage which is in its high state for approximately 18 microseconds and in its low state for approximately 22 microseconds, thereby establishing the 25 kHz horizontal line rate shown in FIG. 2.

In order for the terminal to produce the 3564 display format, it is necessary to increase the free-running period of timing network 96. This is because RC network 96A establishes a period which is too short to allow network 96 to be synchronized by the longer period horizontal sync signal that is associated with the 3564 display format. In the embodiment of FIG. 4, the free-running period of timing network 96 is increased by a timing adjusting network 98 having an input line 172 connected to receive the column select signal and an output line 174 connected to control voltage input CV of timer 140. As will be explained more fully presently, when the column select signal is in its high state, indicating operation of one of the first three display formats, adjusting network 98 effectively disconnects control voltage input CV of timer 140, thereby causing timer 140 to operate in the previously described short period mode. When the column select signal is in its low state, however, indicating operation in the 3564 display format, adjusting network 98 connects input CV of timer 140 to a voltage near +5 volts, thereby causing timer 140 to operate in its longer period mode.

To the end that the desired period adjustment may be made, adjusting network 98 includes NPN switching transistors 175 and 176 having respective collector resistors 178 and 180 and base resistors 182 and 184, and NOR gates 186 and 188. Network 98 also includes an NPN transistor 190 having emitter and base resistors 192 and 194, a capacitor 196, resistors 198 and 200 and a zener diode 102. Of these, transistors 175 and 176 and their associated gates serve to either connect or not connect the voltage divider formed by resisters 178 and 180 to timer input CV, depending upon the state of the column select signal. In addition, transistor 190 and its associated resistors, capacitor and zener diode serve to protect the horizontal deflection circuitry by preventing transistors 175 and 176 from connecting the above-mentioned divider to timer 140 before the dc voltage applied to drive network 90 has dropped to a safe value. More particularly, as the dc voltage applied to drive network 90 drops from the +73 volt level that is associated with operation in any of the first three display formats to the +46 volt level that is associated with operation in the 3564 display format, capacitor 196 maintains conduction through transistor 190, after the voltage across zener diode 202 becomes too low to maintain conduction therethrough, to delay the application of a low-state voltage to gate 188 until enough time has passed to assure that the dc voltage has dropped to a value that is safe for the change to the 3564 display format. Because the operation of adjusting network 98 will be apparent to those skilled in the art, it will not be described in detail herein.

In view of the foregoing, it will be seen that the horizontal deflection circuit of FIG. 4 is adapted to establish either of two selectable horizontal line rates, depending upon the state of the column select signal on line 46. Significantly, as the circuitry changes between its two horizontal line rates, the quality of the display presentation is maintained by making corresponding changes in the degree of S-shaping provided by network 94, the switching frequency of power supply 92, and the free-running period of timing network 96.

In FIG. 5 there is shown a schematic of the preferred embodiment of the vertical deflection circuitry of the invention. As will be explained more fully presently, FIG. 5 includes all of the circuitry necessary to adjust the vertical size of the characters and the spacing between the character rows as necessary to maintain the vertical dimension of the display frame approximately constant for all display formats and to maintain the aspect ratios of the characters within acceptable limits. As in the case of the horizontal deflection circuitry, the vertical deflection circuitry is in part controlled by signals generated by processor 32 and in part by signals generated by controller 30.

Referring to FIG. 5 there is shown what is in most respects a conventional vertical drive network 210 for driving vertical deflection yoke **20*b* in accordance with the vertical sync signal VS which controller 30 applies to input line 38. Also shown in FIG. 5 is a vertical deflection adjusting network 220 which adjusts the timing of drive network 210** in accordance with the states of the format control signals. Among the latter signals are the character height select and column select signals, which together determine the heights of the characters displayed during operation in the 3440 and 3564 display formats, and a stepscan signal which accelerates the motion of the electron beam between character rows during operation in the 3564 display format.

In the preferred embodiment, vertical drive network 210 includes a vertical deflection control chip 222 which may be of the type manufactured by SGS-ATES under the model designation TDA 1170. Generally speaking, chip 222 serves as a current source which is adapted to generate at the OUT pin thereof a signal having a sawtooth waveform suitable for directly driving vertical deflection yoke 20*b*. The period of this sawtooth waveform is determined by the period of the vertical sync signal which is applied to the OSC input of chip 222. The slope and peak amplitude of this sawtooth waveform are controlled in part by capacitors 224 and 226 and resistor 228 which are connected to the RAMP input of chip 222, and in part by the resistance which appears between ground and the HEIGHT input of chip 222. As will be explained more fully presently, the character height select, stepscan and column select signals exert their control over network 210 by controlling the magnitude of the latter resistance.

In order for network 210 to operate properly, chip 222 is connected to a number of associated circuit elements. Included among these is a transistor 230 having collector and emitter resistors 232 and 234, base resistors 236 and 238, and input and output coupling capacitors 240 and 242. Together these circuit elements ac couple vertical sync signal VS to the OSC input of chip 222 to synchronize the operation thereof to the remaining circuitry of FIG. 3. Also included is a RC network 244 which stabilizes the operation of chip 222 and an ac coupling capacitor 246. Because the operation of these elements are understood by those skilled in the art, that operation will not be described in detail herein.

In the embodiment of FIG. 5, adjusting network 220 includes resistors 250 through 258 and non-inverting amplifiers 260 through 264 which are preferably of the open collector type. When any of these amplifiers is in its ON state, the output thereof effectively short circuits the end of the resistor connected thereto to circuit ground. Conversely, when any of these amplifiers is in its OFF state, the output thereof effectively open circuits the end of resistor connected thereto. Since the inputs of these amplifiers are connected to receive the three above-mentioned display format control signals, the states of these amplifiers and, consequently, the magnitude of the resistance which network 220 presents to vertical drive network 210 will depend upon the states of the format control signals. Not affected by amplifiers 260–264 or the format control signals are resistors 254 and 256 which provide a format-independent adjustment of the height of the characters presented on CRT 20. Because the latter resistors are unaffected by the format control signals, they may be considered as establishing a basal or reference value for the resistance which adjusting network 220 presents to drive network 210.

When amplifiers 260 and/or 262 are in their ON states, they effectively connect resistors 250 and/or 252 in parallel with reference resistors 254 and 256 and thereby decrease the resistance which the reference resistors apply to drive network 210. When amplifiers 260 and 262 are in their OFF states, resistors 250 and 252 are effectively disconnected from reference resistors 254 and 256 and thereby have no effect on the resistance which the reference resistors present to drive network 210. Conversely, when amplifier 264 is in its OFF state, resistor 258 is connected in series with reference resistors 254 and 256 and thereby increases the resistance which the reference resistors apply to drive network 210. When amplifier 264 is in its ON state, resistor 258 is effectively short circuited and thereby has no effect on the resistance which the reference resistors apply to drive network 210. It will therefore be seen that, depending on the pattern of states which the format control signals produce in amplifiers 260 through 264, adjusting network 220 may present to vertical drive network 210 an effective resistance which is either larger or smaller than that of reference resistors 254 and 256.

When the terminal is operating in either the 1920 or the 2560 display format, the format control signals on lines 46–50 cause amplifiers 260 and 264 to assume their ON states and amplifier 262 to assume its OFF state. Under this condition, the resistance which adjusting network 220 presents to drive network 220 is equal to that of resistor 250 in parallel with resistors 254 and 256. As a result adjusting network 220 presents a relatively low resistance to drive network 210, causing a relatively steeply sloped sawtooth waveform to be applied to yoke 20*b*. Together with the relatively large number of scan lines per character row that is associated with the 1920 and 2560 display formats, this causes the terminal to produce the relatively tall characters which are desireable in order to fill the vertical dimension of the display frame in these formats.

When the terminal is operating in the 3440 display format, the format control signals on lines 46–50 cause amplifiers 260 and 262 to assume their OFF states and amplifier 264 to assume its ON state. Under this condition, none of resistors 250, 252 and 258 affect the resistance which adjusting network 220 presents to drive network 210. As a result, adjusting network 220 presents a relatively higher resistance to drive network 210, causing a relatively less steeply sloped sawtooth waveform to be applied to yoke 20*b*. Together with the reduced number of scan lines per character row that is associated with the 3440 display format, this causes the terminal to produce the relatively shorter characters and high row packing density which are desireable in order to maintain all character information within the display frame in this format.

When the terminal is operating in the 3564 display format, the format control signals on lines 46 and 48 cause amplifiers 260 and 264 to assume their OFF states while the formal control (stepscan) signal on line 50 causes amplifier 262 switch between its ON and OFF states, depending upon whether the electron beam is located within or between character rows. As a result, resistor 250 is continuously disconnected from resistors 254 and 256, and resistor 258 is continuously connected in series with resistors 254 and 256, while resistor 252 is switched from being connected in parallel with resistors 254 through 258 to being disconnected therefrom, depending on the state of the stepscan signal. Under the former (non-stepscan) condition, adjusting network 220 presents its relatively highest resistance to drive network 210 and thereby causes vertical deflection network 210 to apply the least steeply sloped sawtooth waveform to yoke 20*b*. Because of the long horizontal line period that is used in the 3564 format, however, the electron beam traverses the same vertical distance between lines in the 3564 format as it does in the 3440 format, and therefore causes the characters of the 3564 format to be just as tall as those of the 3440 format.

Under the latter (stepscan) condition, adjusting network 220 presents its relatively lowest resistance to drive network 210 and thereby causes network 210 to apply the most steeply sloped sawtooth waveform to yoke 20*b*. This, in turn, causes the electron beam to move rapidly between character rows and thereby produce character rows which are more widely spaced than those of the 3440 display format. Thus, in spite of its smaller number of horizontal scan lines and slower horizontal sweep rate, the display frames of the 3564 display format have approximately the same vertical dimension as those of the 3440 display format.

In order to avoid burdening processor 32 with the task of directly initiating each change in the state of the stepscan signal, the latter signal is preferably not generated in the same manner as the other display format control signals, i.e., via control register 42 of FIG. 3. Instead the stepscan signal is generated indirectly via latch 51 of FIG. 3 which is connected to one of the data output lines of the character memory (76) that is used with the 3564 display format. This allows changes in the state of the stepscan signal to be initiated by non-displayable stepscan control bits which are stored in memory 76 along with the character data for the last line of each character row. As a result, when character data for the last line of the last character position of a row is read, this low state control bit is latched into latch 51 by the accompanying transition of the horizontal sync signal on line 36 and thereby made available to vertical deflection circuit 26. This control bit is eliminated by the next transition of the horizontal sync signal since, by the time that the latter transition occurs, scan line register 80 will have advanced the memory address to the first line of the next character row, which line does not include any stepscan control bit.

In order to assure that the above mentioned control bits initiate stepscan only during operation in the 3440 display format, processor 32 is programmed to write those control bits into memory 76 as a part of the process of establishing operation in the 3440 display format and to erase those control bits therefrom as a part of the process of terminating operation in the 3440 display format. While this writing and erasing represents some burden on processor 32, this burden is considerably less than that which would be involved if processor 32 had to directly initiate each stepscan event. This is because this burden must be carried only at those relatively infrequent times when the 3564 display format is being established or terminated.

While processor 32 uses character memory 76 to control stepscan in the preferred embodiment of the invention, this use is not essential to the practice of the present invention. Stepscan may, for example, also be controlled by hard-wired circuitry which is connected to scan line register 80 and double row buffer 60 and which is arranged to respond to the occurrence of the last line of the last character in a row by initiating stepscan for a predetermined number of character clock periods. Stepscan may also be controlled by a hard-wired circuitry which cyclically initiates stepscan in response to the occurrence of the number of character clock periods that correspond to the presentation of each complete character row. In each case, the stepscan circuitry is preferably enabled by processor 32 only during operation in the 3564 display format as, for example, by writing a suitable format control bit into control register 42. It will be understood that the present invention is intended to encompass these and all other means for producing the above-described stepscan function.

In view of the foregoing, it will be seen that the terminal of the invention includes a vertical deflection adjusting network which serves to establish that one or more of a plurality of predetermined sawtooth waveform slopes which assures that a display frame having an approximately constant vertical dimension is substantially filled by equally spaced character rows for each of the different display formats discussed in connection with FIG. 1 and 2.

As explained earlier, the establishment of desired one of four different display formats by the terminal of the invention is controlled in part by CRT controller 30 in response to the display parameters which are programmed therein by terminal processor 32 . If controller 3O is of the type described in connection with FIG. 3, these parameters are programmed by loading appropriate numbers into its horizontal and vertical timing registers. This may, for example, be accomplished by addressing these registers via address inputs VA3-0 of controller 30 and then writing data therein via data inputs VD7-0 thereof. For the sake of completeness, there follows a list of the types of parameters which are loaded into these registers, together with a brief description thereof.

HORIZONTAL TIMING PARAMETERS

A. Characters Per Horizontal Period—This parameter is a number which gives the total number of character clock periods in the horizontal period of the display (trace time plus retrace time).

B. Characters Per Data Row—This parameter is a number which gives the number of characters to be displayed during the horizontal trace interval. The difference between this parameter and the preceding parameter gives the number of character clock periods which are reserved for horizontal retrace.

C. Horizontal Delay—This parameter is a number, expressed in character clock periods, which gives the time delay between the leading edge of the horizontal sync signal and the beginning of the display and therefore determines the width of the horizontal margins of the display frame.

D. Horizontal Sync Width—This parameter is a number, expressed in character clock periods, which gives the width of the horizontal sync signal.

VERTICAL TIMING PARAMETERS

A. Visible Data Rows Per Frame—This parameter gives the number of displayed character rows, not counting the status row.

B. Scan Lines Per Data Row—This parameter gives the number of horizontal scan lines per character row.

C. Scan Lines Per Vertical Period—This parameter gives the number of horizontal scan lines in each vertical period.

D. Vertical Delay—This parameter is a number, expressed in horizontal periods, which specifies the time delay between the leading edge of the vertical sync signal and the beginning of the display frame and therefore determines the width of the vertical margins of the display frame.

E. Vertical Sync Width—This parameter is a number expressed in horizontal periods, which gives the width of the vertical sync signal. Because the numbers used as horizontal and vertical timing parameters vary from display to display, it is not possible to provide a set of numerical parameters values which are usable with all displays. Since the parameter values that are used to produce the results described in connection with FIG. 1 will be apparent to those skilled in the art from the numbers listed in FIG. 2, those values will not be specifically discussed herein.

In view of the foregoing, it will be seen that a display terminal constructed in accordance with the present invention represents a simple and cost-effective solution to the problem of providing a plurality of different display formats on a single display terminal which does not include duplicate sets of terminal circuitry and which uses only a singe dot clock and character clock frequencies.

What is claimed is:

1. An apparatus for displaying rows of characters, in a plurality of different display formats, said display formats being characterized by display frames that include different respective numbers of characters and different respective numbers of character rows, comprising:

(a) a CRT display;

(b) CRT control means for controlling the timing of the display, said control means including means for generating horizontal and vertical sync signals and means for storing a set of display parameters including at least:

(i) the number of character rows in each display frame, (ii) the number of characters in each character row, and (iii) the number of horizontal scan lines in each character row;

(c) memory means for storing data indicative of the characters to be displayed within the display frame and for storing one set of said display parameters for each of said display formats;

(d) a digital computer connected to the memory means and the CRT control means for loading the CRT control means with a selected one of said sets of display parameters, and for generating a plurality of sets of display format control signals, each set of display parameters and display format control signals being associated with a respective one of said display formats;

(e) a horizontal deflection circuit responsive to the display format control signals and to the horizontal sync signal for driving the electron beam of the display at one of at least first and second horizontal rates;

(f) a vertical deflection circuit responsive to the display format control signals and to the vertical sync signal for driving the electron beam of the display at one of at least first and second vertical rates;

(g) format indicating means for specifying the display format to be used in displaying characters on said CRT display;

(h) dot clock generating means connected to the CRT display for generating a constant frequency dot clock signal for use in controlling said electron beam;

(i) wherein the display frames associated with different display formats have approximately constant dimensions.

2. The apparatus of claim 1 in which the display formats include:

(a) a 1920 display format comprising 24 character rows each including up to 80 characters;

(b) a 2560 display format comprising 32 character rows each including up to 80 characters,;

(c) a 3440 format comprising 43 character rows each including up to 80 characters; and (d) a 3564 display format comprising 27 character rows each including up to 132 characters.

3. The apparatus of claim 1 further including first and second character memories for storing, for each displayable character, digital data defining the shape of that character in different respective fonts, a video generator connected to the display, and means for applying one of the display format control signals to the character memories to selectively connect one of the character memories to the video generator.

4. The apparatus of claim 2 further including first and second character memories for storing, for each displayable character, digital data defining the shape of that character in different respective fonts, a video generator connected to the display, and means for applying one of the display format control signals to the character memories to selectively connect one of the character memories to the video generator.

5. The apparatus of claim 3 in which each set of display format control signals includes at least a memory select signal for controlling the selection of one of the character memories, a horizontal rate select signal for controlling the selection of one of said horizontal rates, and at least one vertical rate select signal for controlling the selection of one of said vertical rates.

6. The apparatus of claim 4 in which the characters of the 1920 and 2560 display formats have the same height and are produced from digital data stored in the same character memory, and in which the 2560 display format uses more closely spaced character rows than the 1920 display format.

7. The apparatus of claim 6 in which the number of blank horizontal scan lines between the character rows of the 2560 display format is smaller than that between the character rows of the 1920 display format.

8. The apparatus of claim 4 in which the 3440 and 3564 display formats are produced from digital data stored in the same character memory, and in which the 3564 display format uses more widely spaced character rows than the 3440 display format.

9. The apparatus of claim 8 in which the vertical deflection circuit includes stepscan circuitry, and in which the stepscan circuitry is actuated during operation in the 3564 display format to increase the vertical spacing of the character rows.

10. The apparatus of claim 1 in which the horizontal deflection circuit includes a power supply for producing one of at least two different dc operting voltages, depending upon the state of one of the display format control signals.

11. The apparatus of claim 10 in which the power supply is a switching-type power supply, and in which the switching of said power supply is synchronized with the horizontal sync signal.

12. The apparatus of claim 1 in which the horizontal deflection circuit includes an S-shaping network for causing that circuit to exhibit at least one of two degrees of S-shaping, depending upon the state of one of the display format control signals.

13. The apparatus of claim 1 in which the vertical deflection circuit includes means for generating a generally sawtooth shaped output signal, the rate of change of the sawtooth signal having at least two different values, depending upon the states of the display format control signals.

14. The apparatus of claim 13 in which the generating means includes an adjusting network including a plurality of resistors, and in which the different values of said rate of change are produced by controllably connecting and disconnecting said resistors.

15. The apparatus of claim 1 further including character memory means for storing, for each displayable character, digital data defining the shape of that character in at least two different fonts, and for storing, for at least one display format, digital data specifying at least one of the display format control signals associated with that display format.

16. The apparatus of claim 15 in which the vertical deflection circuit includes stepscan circuitry, and in which predetermined bits of the digital data stored in the character memory means are used to control the actuation of the stepscan circuitry.

17. An apparatus for displaying rows of characters, in a plurality of different display formats, said display formats being characterized by display frames that include different respective numbers of characters and different respective numbers of character rows, comprising:

(a) a cathode ray tube display;

(b) signal generating means for generating a dot clock signal having a predetermined dot clock period;

(c) means responsive to the dot clock signal for generating a character clock signal having a predetermined character clock period;

(d) first programmable control means responsive to said character clock signal for controlling said display, said control means including means for generating horizontal and vertical sync signals in accordance with a set of display parameters including at least:

(i) the number of character clock periods corresponding to the horizontal dimension of the display frame (ii) the number of character rows corresponding to the vertical dimension of the display frame, and (iii) the number of horizontal scan lines within each character row;

(e) first memory means for storing digital data indicative of the characters to be displayed within the display frame and for storing one set of display parameters for each of said display formats;

(f) second programmable control means for selectively establishing each of the display formats, said second programmable control means including means for loading the first programmable control means with a selected one of a plurality of sets of display parameters, and for generating a selected one of a plurality of sets of display format control signals, each of said sets being associated with a respective one of the display formats;

(g) a horizontal deflection circuit responsive to the horizontal sync signal and the display format control signals for driving the electron beam of the display at one of at least two different horizontal rates;

(h) a vertical deflection circuit responsive to the vertical sync signal and the display format control signals for driving the electron beam of the display at one of at least two different vertical rates;

(i) a video generator responsive to the dot clock signal for applying to the display a video signal indicative of the characters to be displayed, (j) second memory means responsive to the display format control signals for storing, for each displayable character, digital data defining the shape of that character in at least two different respective fonts, and for providing that digital data to the video generator in a font which is compatible with the display format selected by the second programmable control means;

(k) format indicating means for indicating the display format to be used in displaying characters on said cathode ray tube display;

(l) wherein the display frames of different display formats have approximately constant dimensions.

18. The apparatus of claim 17 in which the display formats include:

(a) a 1920 display format comprising 24 character rows each including up to 80 characters;

(b) a 2560 display format comprising 32 character rows each including up to 80 characters;

(c) a 3440 display format comprising 43 character rows each including up to 80 characters; and (d) a 3564 display format comprising 27 character rows each including up to 132 characters.

19. The apparatus of claim 17 in which said display format control signals include at least a font select signal for controlling the selection of one of said fonts, a horizontal rate select signal for controlling said horizontal rate, and at least one vertical rate signal for controlling said vertical rate.

20. The apparatus of claim 18 in which the characters of the 1920 and 2560 display formats are the same size, but in which the character rows of the 2560 display format are more closely spaced than those of the 1920 display format.

21. The apparatus of claim 20 in which the closer spacing of the character rows in the 2560 display format is produced by programming the first programmable control means to reduce the number of horizontal scan lines associated with each character row.

22. The apparatus of claim 18 in which each character of the 3440 display format is formed by the same number of dots and lines as the corresponding character of the 3564 display format, but in which the character rows of the 3564 display format are more widely spaced than those of the 3440 display format.

23. The apparatus of claim 22 in which the vertical deflection circuit includes stepscan circuitry, and in which the stepscan circuitry is actuated during operation in the 3564 display format to increase the vertical spacing of the character rows.

24. The apparatus of claim 17 in which the horizontal deflection circuit includes a power supply for producing one of at least two different dc operating voltages, depending upon the state of one of the display format control signals.

25. The apparatus of claim 17 in which the horizontal deflection circuit includes an S-shaping network for causing that circuit to exhibit a selectable one of two different degrees of S-shaping, depending upon the state of one of the display format control signals.

26. The apparatus of claim 17 in which the horizontal deflection circuit includes an S-shaping network for causing that circuit to exhibit one of at least two different degrees of S-shaping, depending upon the state of one of the display format control signals.

27. The apparatus of claim 17 in which the vertical deflection circuit includes means for generating a generally sawtooth shaped output signal, the rate of change of said sawtooth signal having one of at least two different values, depending upon the states of the display format control signals.

28. The apparatus of claim 27 in which the generating means includes an adjusting network including a plurality of resistors, and in which the different values of said rate of change are produced by controllably connecting and disconnecting said resistors.

29. The apparatus of claim 17 in which the second memory means serves to store, for at least one display format, digital data specifying at least one of the display format control signals associated with that display format.

30. The apparatus of claim 29 in which the vertical deflection circuit includes stepscan circuitry, and in which predetermined bits of the digital data stored in the second memory means are used to control the actuation of the stepscan circuitry.

31. The apparatus of claim 17, further including a control register, in which the second programmable control means generates at least two of the display format control signals by outputting a multi-bit digital word to the control register.

32. The apparatus of claim 17 in which the second programmable control means is programmed to refer to the format indicating means, during the vertical retrace interval of the display, to determine if a change in the display format is required.

33. The apparatus of claim 32 in which required changes in display format are completed during the vertical retrace interval, thereby preventing the presentation of display frames that include erroneous character information.

34. The apparatus of claim 17 further including a double row buffer, connected to the first memory means and to the first programmable control means, for successively storing codes indicative of the characters which are to appear on successive complete rows of the display during operation in each display format.

35. The apparatus of claim 34 in which the first memory means stores said codes for all of the characters which are to be presented during a complete display frame, in a row table format, and in which the second programmable control means is programmed to rewrite said codes in a row table format suitable for use with a particular display format in the course of establishing that display format.

* * * * *